US012747602B2

(12) United States Patent
Gentile

(10) Patent No.: US 12,747,602 B2
(45) Date of Patent: Sep. 29, 2026

(54) VALVE MANIFOLD FOR A POOL ENVIRONMENT CONTROL SYSTEM

(71) Applicant: PoolAire, Inc., Peachtree Corners, GA (US)

(72) Inventor: Anthony Gentile, Peachtree Corners, GA (US)

(73) Assignee: PoolAire, Inc., Peachtree Corners, GA (US)

( * ) Notice: Subject to any disclaimer, the term of this patent is extended or adjusted under 35 U.S.C. 154(b) by 162 days.

(21) Appl. No.: 18/629,372

(22) Filed: Apr. 8, 2024

(65) Prior Publication Data

US 2025/0314085 A1 Oct. 9, 2025

(51) Int. Cl.

| | |
|---|---|
| ***F25B 41/20*** | (2021.01) |
| ***E04H 4/12*** | (2006.01) |
| ***F25B 41/42*** | (2021.01) |

(52) U.S. Cl.

CPC ..... *E04H 4/129* (2013.01); *F25B 41/20* (2021.01); *F25B 41/42* (2021.01); *F25B 2500/26* (2013.01); *F25B 2600/25* (2013.01)

(58) Field of Classification Search

CPC ..... E04H 4/12; E04H 4/1209; E04H 4/129; F25B 2500/26

See application file for complete search history.

(56) References Cited

U.S. PATENT DOCUMENTS

2004/0089015 A1* 5/2004 Knight ..... F25B 6/02 62/176.1

2006/0107685 A1* 5/2006 Lifson ..... F24F 3/153 62/428

(Continued)

FOREIGN PATENT DOCUMENTS

| | | | | |
|---|---|---|---|---|
| CN | 209840450 U | * | 12/2019 | |
| GB | 2148553 A | * | 5/1985 | ..... G05D 23/1931 |
| KR | 102239638 B1 | * | 4/2021 | ..... F24F 11/70 |

OTHER PUBLICATIONS

International Searching Authority (ISA/US). International Search Report and Written Opinion for International Application No. PCT/US2025/023629, dated Jun. 16, 2025, 10 Pages.

*Primary Examiner* — Jerry-Daryl Fletcher
*Assistant Examiner* — Daniel C Comings
(74) *Attorney, Agent, or Firm* — Meunier Carlin & Curfman LLC

(57) ABSTRACT

A pool environment control system including a reheat branch including a reheat soft-start electronic solenoid valve configured to fluidly couple to a compressor, a reheat primary electronic solenoid valve configured to fluidly couple to the compressor, and a reheat check valve fluidly coupled to the reheat soft-start electronic solenoid valve and the reheat primary electronic solenoid valve, the reheat check valve configured to provide fluid communication with a reheat system. The pool environment control system further including an air-cooled condenser (ACC) branch including an ACC soft-start electronic solenoid valve fluidly coupled to the compressor, an ACC primary electronic solenoid valve fluidly coupled to the compressor, and an ACC check valve fluidly coupled to the ACC soft-start electronic solenoid valve and the ACC primary electronic solenoid valve, the ACC check valve configured to provide fluid communication with an ACC system.

20 Claims, 3 Drawing Sheets

(56) References Cited

U.S. PATENT DOCUMENTS

| | | | | |
|---|---|---|---|---|
| 2013/0269096 | A1 | 10/2013 | Pleva | |
| 2013/0340455 | A1 | 12/2013 | Martin et al. | |
| 2016/0069575 | A1* | 3/2016 | Anderson | F24F 3/147 62/304 |
| 2017/0363334 | A1* | 12/2017 | Malik | F25B 25/005 |
| 2020/0378630 | A1* | 12/2020 | Kalambe | F24F 3/153 |
| 2022/0312160 | A1 | 9/2022 | Briggs et al. | |
| 2023/0151894 | A1* | 5/2023 | Bryant | F16K 11/0712 137/625.48 |
| 2026/0009563 | A1* | 1/2026 | Shanmugam | F25B 9/008 |

* cited by examiner

VALVE MANIFOLD FOR A POOL ENVIRONMENT CONTROL SYSTEM

BACKGROUND

This disclosure relates to valve manifold systems. More particularly, the disclosure relates to pool dehumidifier systems including valve manifolds supporting multiple functions.

SUMMARY

In some aspects, the techniques described herein relate to a pool environment control system including: a reheat branch including a reheat soft-start electronic solenoid valve configured to fluidly couple to a compressor, a reheat primary electronic solenoid valve configured to fluidly couple to the compressor, and a reheat check valve fluidly coupled to the reheat soft-start electronic solenoid valve and the reheat primary electronic solenoid valve, the reheat check valve configured to provide fluid communication with a reheat system; and an air-cooled condenser (ACC) branch including an ACC soft-start electronic solenoid valve fluidly coupled to the compressor, an ACC primary electronic solenoid valve fluidly coupled to the compressor, and an ACC check valve fluidly coupled to the ACC soft-start electronic solenoid valve and the ACC primary electronic solenoid valve, the ACC check valve configured to provide fluid communication with an ACC system.

In some aspects, the techniques described herein relate to a pool environment control system, further including: a primary rail configured to be fluidly coupled to the compressor; and a soft-start rail configured to be fluidly coupled to the compressor.

In some aspects, the techniques described herein relate to a pool environment control system, wherein the reheat primary electronic solenoid valve and the ACC primary electronic solenoid valve are fluidly coupled to the primary rail, and wherein the reheat soft-start electronic solenoid valve and the ACC soft-start electronic solenoid valve are fluidly coupled to the soft-start rail.

In some aspects, the techniques described herein relate to a pool environment control system, wherein the reheat soft-start electronic solenoid valve and the reheat primary electronic solenoid valve provide parallel flow paths between the compressor and the reheat check valve, and wherein the ACC soft-start electronic solenoid valve and the ACC primary electronic solenoid valve provide parallel flow paths between the compressor and the ACC check valve.

In some aspects, the techniques described herein relate to a pool environment control system, further including an upstream isolation valve arranged upstream of the reheat soft-start electronic solenoid valve, the reheat primary electronic solenoid valve, the ACC soft-start electronic solenoid valve, and the ACC primary electronic solenoid valve.

In some aspects, the techniques described herein relate to a pool environment control system, further including: a reheat isolation valve positioned downstream of the reheat check valve; and an ACC isolation valve positioned downstream of the ACC check valve.

In some aspects, the techniques described herein relate to a pool environment control system, wherein at least one of the reheat branch or the ACC branch is a multi-stage branch.

In some aspects, the techniques described herein relate to a pool environment control system, further including a heat reclaim branch including a reclaim soft-start electronic solenoid valve configured to be fluidly coupled to the compressor, a reclaim primary electronic solenoid valve configured to be fluidly coupled to the compressor, and a reclaim check valve fluidly coupled to the reclaim soft-start electronic solenoid valve and the reclaim primary electronic solenoid valve, the reclaim check valve configured to provide fluid communication with a heat reclaim system.

In some aspects, the techniques described herein relate to a pool environment control system, further including one or more processing circuits including one or more memory devices coupled to one or more processors, the one or more memory devices configured to store instructions thereon that, when executed by the one or more processors, cause the one or more processors to: open the reheat soft-start electronic solenoid valve for a predetermine reheat soft-start time; open the reheat primary electronic solenoid valve after the predetermined reheat soft-start time; close the reheat soft-start electronic solenoid valve after the predetermined reheat soft-start time; open the ACC soft-start electronic solenoid valve for a predetermined ACC soft-start time; open the ACC primary electronic solenoid valve after the predetermined ACC soft-start time; and close the ACC soft-start electronic solenoid valve after the predetermined ACC soft-start time.

In some aspects, the techniques described herein relate to a multi-mode valve manifold including: a primary rail configured to fluidly couple to an upstream isolation valve; a soft-start rail configured to fluidly couple to the upstream isolation valve; a reheat branch including a reheat soft-start electronic solenoid valve fluidly coupled to the soft-start rail, a reheat primary electronic solenoid valve fluidly coupled to the primary rail, and a reheat isolation valve coupled to the reheat soft-start electronic solenoid valve and the reheat primary electronic solenoid valve and configured to selectively provide fluid flow to a reheat system; a heat reclaim branch including a reclaim soft-start electronic solenoid valve fluidly coupled to the soft-start rail, a reclaim primary electronic solenoid valve fluidly coupled to the primary rail, and a reclaim isolation valve coupled to the reclaim soft-start electronic solenoid valve and the reclaim primary electronic solenoid valve and configured to selectively provide fluid flow to a heat reclaim system; and an ACC branch including an ACC soft-start electronic solenoid valve fluidly coupled to the soft-start rail, an ACC primary electronic solenoid valve fluidly coupled to the primary rail, and an ACC isolation valve coupled to the ACC soft-start electronic solenoid valve and the ACC primary electronic solenoid valve and configured to selectively provide fluid flow to an ACC system.

In some aspects, the techniques described herein relate to a multi-mode valve manifold, wherein at least one branch, or the ACC branch is a multi-stage branch.

In some aspects, the techniques described herein relate to a multi-mode valve manifold, wherein the reheat branch includes a reheat check valve fluidly coupled upstream branch includes a reclaim check valve fluidly coupled upstream isolation valve, and wherein the ACC branch includes an ACC check valve fluidly coupled upstream of the ACC isolation valve.

In some aspects, the techniques described herein relate to a multi-mode valve manifold, wherein the reheat soft-start electronic solenoid valve and the reheat primary electronic solenoid valve provide parallel flow paths between the upstream isolation valve and the reheat isolation valve, wherein the reclaim soft-start electronic solenoid valve and the reclaim primary electronic solenoid valve provide parallel flow paths between the upstream isolation valve and the reclaim isolation valve, and wherein the ACC soft-start electronic solenoid valve and the ACC primary electronic solenoid valve provide parallel flow paths between the upstream isolation valve and the ACC isolation valve.

In some aspects, the techniques described herein relate to a multi-mode valve manifold, further including one or more processing circuits including one or more memory devices coupled to one or more processors, the one or more memory devices configured to store instructions thereon that, when executed by the one or more processors, cause the one or more processors to: open the reheat soft-start electronic solenoid valve for a predetermine reheat soft-start time; open the reheat primary electronic solenoid valve after the predetermined reheat soft-start time; close the reheat soft-start electronic solenoid valve after the predetermined reheat soft-start time; open the reclaim soft-start electronic solenoid valve for a predetermine reclaim soft-start time; open the reclaim primary electronic solenoid valve after the predetermined reclaim soft-start time; close the reclaim soft-start electronic solenoid valve after the predetermined reclaim soft-start time; open the ACC soft-start electronic solenoid valve for a predetermined ACC soft-start time; open the ACC primary electronic solenoid valve after the predetermined ACC soft-start time; and close the ACC soft-start electronic solenoid valve after the predetermined ACC soft-start time.

In some aspects, the techniques described herein relate to a non-transitory computer readable media having computer-executable instructions embodied therein that, when executed by a circuit of a pool environment control system, causes the pool environment control system to perform functions including: opening a reheat soft-start electronic solenoid valve for a predetermined reheat soft-start time; opening a reheat primary electronic solenoid valve after the predetermined reheat soft-start time; closing the reheat soft-start electronic solenoid valve after the predetermined reheat soft-start time; opening an ACC soft-start electronic solenoid valve for a predetermined ACC soft-start time; opening an ACC primary electronic solenoid valve after the predetermined ACC soft-start time; and closing the ACC soft-start electronic solenoid valve after the predetermined ACC soft-start time.

In some aspects, the techniques described herein relate to a non-transitory computer readable media having computer-executable instructions, wherein the source functions include one or more of: opening a reclaim soft-start electronic solenoid valve for a predetermined reclaim soft-start time; opening a reclaim primary electronic solenoid valve after the predetermined reclaim soft-start time; and closing the reclaim soft-start electronic solenoid valve after the predetermined reclaim soft-start time.

In some aspects, the techniques described herein relate to a non-transitory computer readable media having computer-executable instructions, wherein the source functions include one or more of: receiving a reclaim-on command from a human-machine interface; and starting the predetermined reclaim soft-start time in response to receiving the reclaim-on command.

In some aspects, the techniques described herein relate to a non-transitory computer readable media having computer-executable instructions, wherein the source functions include one or more of: receiving a reheat-on command from a human-machine interface; and starting the predetermined reheat soft-start time in response to receiving the reheat-on command.

In some aspects, the techniques described herein relate to a non-transitory computer readable media having computer-executable instructions, wherein the source functions include one or more of: receiving an ACC-on command from a human-machine interface; and starting the predetermined ACC soft-start time in response to receiving the ACC-on command.

In some aspects, the techniques described herein relate to a non-transitory computer readable media having computer-executable instructions, wherein the source functions include one or more of: controlling a two-stage reheat branch including the reheat soft-start electronic solenoid valve, a second reheat soft-start electronic solenoid valve, the reheat primary electronic solenoid valve, and a second reheat primary electronic solenoid valve.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF DRAWINGS

The device is explained in even greater detail in the following drawings. The drawings are merely exemplary and certain features may be used singularly or in combination with other features. The drawings are not necessarily drawn to scale.

DETAILED DESCRIPTION

Following below are more detailed descriptions of concepts related to, and implementations of, methods, apparatuses, and systems for pool environment control. The figures illustrate exemplary implementations in detail and the present disclosure is not limited to the details or methodology set forth in the description or illustrated in the figures. The terminology used herein is for the purpose of description only and should not be regarded as limiting.

Referring to the figures generally, the various implementations disclosed herein relate to systems, apparatuses, and methods for pool temperature control that includes a multi-mode valve manifold. A pool environment control system including the multi-mode valve manifold provides a reheating branch, an air-cooled condenser branch, and reclaimed heat branch. Each of the branches includes a primary electronic solenoid valve, a soft-start electronic solenoid valve, a one-way check valve, and a downstream isolation valve. The pool environment control system controls operation of the branches to provide a reheat mode, an air-cooled condenser mode, and a reclaimed heat mode with reduced hammering and back flow, and the ability to isolate each branch for maintenance.

Figure 1:
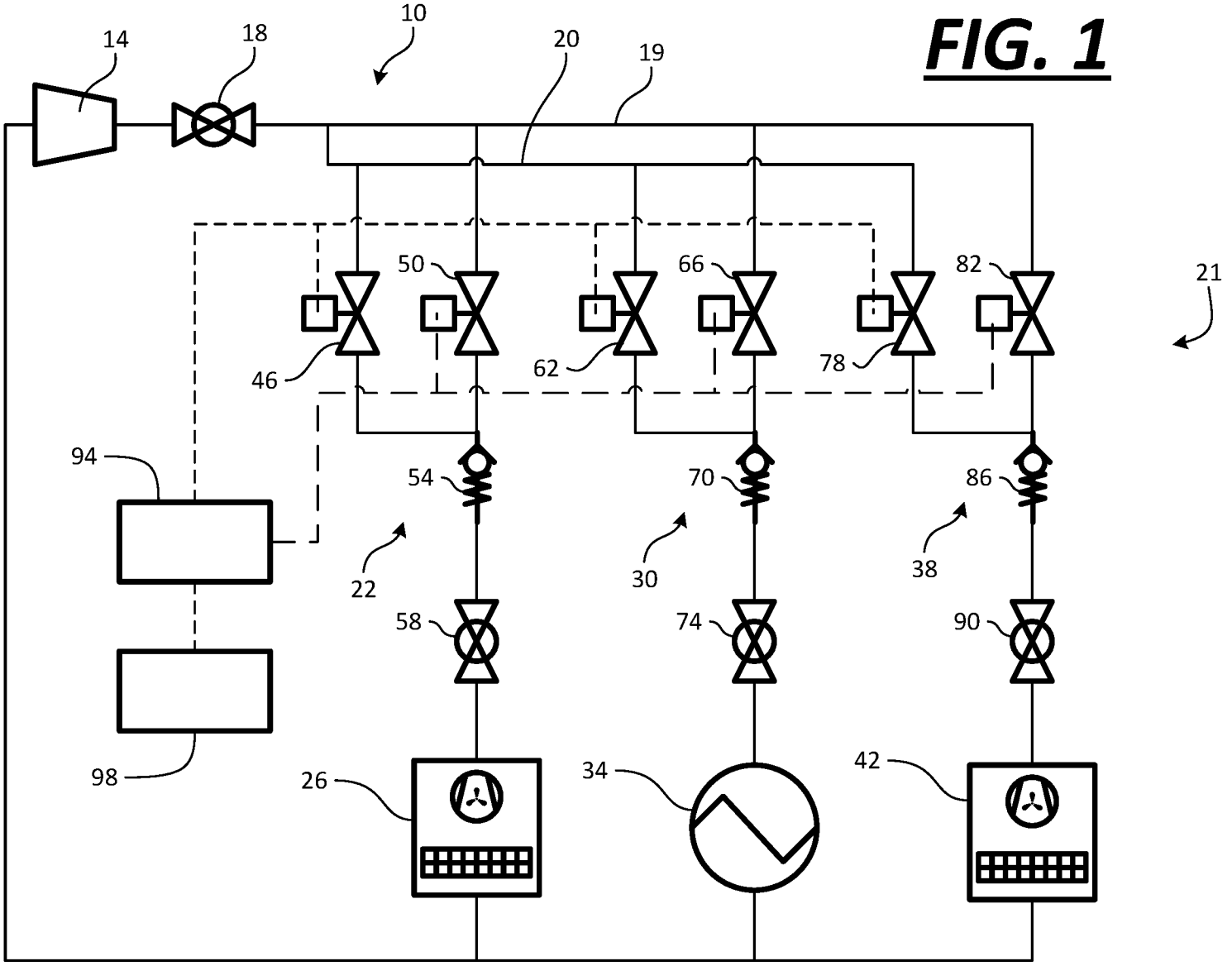
FIG. 1 is a schematic diagram of a pool environment control system including a multi-mode valve manifold, according to some implementations.

As shown in FIG. 1, a pool environment control system 10 includes a compressor 14 (e.g., a piston pump compressor, a screw compressor, etc.), an upstream isolation valve 18 (e.g., a ball valve) that can be manually operated to inhibit flow from the compressor 14. A multi-mode valve manifold 21 includes a reheat branch 22 that selectively fluidly couples the upstream isolation valve 18 to a reheat system 26, a heat reclaim branch 30 that selectively fluidly couples the upstream isolation valve 18 to a heat reclaim system 34, and an air-cooled condenser (ACC) branch 38 that selectively fluidly couples the upstream isolation valve 18 to an ACC system 42. Generally, the reheat system 26 is used during dehumidification of pool environment air, the heat reclaim system 34 is used to directly heat pool water using the residual heat in the pool environment control system 10 via a heat exchanger (e.g., a shell-in-tube heat exchanger), and the ACC system 42 provides air conditioning. Each of the reheat branch 22, the heat reclaim branch 30, and the ACC branch 38 are fluidly coupled to the upstream isolation valve 18 via a primary rail 19 and a soft-start rail 20. In some implementations, the primary rail 19 defines a larger diameter or a higher flow rate than the soft-start rail 20.

The reheat branch 22 includes a soft-start valve in the form of a reheat soft-start electronic solenoid valve 46 that fluidly coupled to the soft-start rail 20 and a primary valve in the form of a reheat primary electronic solenoid valve 50 that is fluidly coupled to the primary rail 19. In some implementations, the reheat soft-start electronic solenoid valve 46 and the reheat primary electronic solenoid valve 50 are normally closed, spring return solenoid valves with a 120 VAC actuation circuit. In some implementations, a different type of electronically controlled valve (e.g., electric actuated butterfly valve) is used. In some implementations, the reheat soft-start electronic solenoid valve 46 and the reheat primary electronic solenoid valve 50 are ball valves. In some implementations, manually actuated valves may be used.

The reheat soft-start electronic solenoid valve 46 and the reheat primary electronic solenoid valve 50 define parallel flow paths (i.e., primary, and soft-start) between the upstream isolation valve 18 and a reheat check valve 54. The reheat check valve 54 inhibits reverse flow toward the reheat soft-start electronic solenoid valve 46 and the reheat primary electronic solenoid valve 50. In some implementations, the reheat check valve 54 is a spring biased check valve. In some implementations, the reheat check valve 54 is a tunable check valve that defines an adjustable opening pressure. A reheat isolation valve 58 is arranged downstream of the reheat check valve 58. In some implementations, the reheat isolation valve 58 is a manual ball valve.

The heat reclaim branch 30 includes a soft-start valve in the form of a reclaim soft-start electronic solenoid valve 62 that fluidly coupled to the soft-start rail 20 and a primary valve in the form of a reclaim primary electronic solenoid valve 66 that is fluidly coupled to the primary rail 19. In some implementations, the reclaim soft-start electronic solenoid valve 62 and the reclaim primary electronic solenoid valve 66 are normally closed, spring return solenoid valves with a 120 VAC actuation circuit. In some implementations, a different type of electronically controlled valve (e.g., electric actuated butterfly valve) is used. In some implementations, the reclaim soft-start electronic solenoid valve 62 and the reclaim primary electronic solenoid valve 66 are ball valves. In some implementations, manually actuated valves may be used.

The reclaim soft-start electronic solenoid valve 62 and the reclaim primary electronic solenoid valve 66 define parallel flow paths (i.e., primary, and soft-start) between the upstream isolation valve 18 and a reclaim check valve 70. The reclaim check valve 70 inhibits reverse flow toward the reclaim soft-start electronic solenoid valve 62 and the reclaim primary electronic solenoid valve 66. In some implementations, the reclaim check valve 70 is a spring biased check valve. In some implementations, the reclaim check valve 70 is a tunable check valve that defines an adjustable opening pressure. A reclaim isolation valve 74 is arranged downstream of the reclaim check valve 70. In some implementations, the reclaim isolation valve 74 is a manual ball valve.

The ACC branch 38 includes a soft-start valve in the form of an ACC soft-start electronic solenoid valve 78 that fluidly coupled to the soft-start rail 20 and a primary valve in the form of an ACC primary electronic solenoid valve 82 that is fluidly coupled to the primary rail 19. In some implementations, the 78/and the 82/are normally closed, spring return solenoid valves with a 120 VAC actuation circuit. In some implementations, a different type of electronically controlled valve (e.g., electric actuated butterfly valve) is used. In some implementations, the 78/and the 82/are ball valves. In some implementations, manually actuated valves may be used.

The ACC soft-start electronic solenoid valve 78 and the ACC primary electronic solenoid valve 82 define parallel flow paths (i.e., primary, and soft-start) between the upstream isolation valve 18 and an ACC check valve 86. The ACC check valve 86 inhibits reverse flow toward the ACC soft-start electronic solenoid valve 78 and the ACC primary electronic solenoid valve 82. In some implementations, the ACC check valve 86 is a spring biased check valve. In some implementations, the ACC check valve 86 is a tunable check valve that defines an adjustable opening pressure. An ACC isolation valve 90 is arranged downstream of the ACC check valve 86. In some implementations, the ACC isolation valve 90 is a manual ball valve.

A controller 94 is structured in electrical communication with the reheat soft-start electronic solenoid valve 46, the reclaim soft-start electronic solenoid valve 62, the ACC soft-start electronic solenoid valve 78, the reheat primary electronic solenoid valve 50, the reclaim primary electronic solenoid valve 66, and the ACC primary electronic solenoid valve 82 to actuate each of the valves between an open position and a closed position to selectively provide operation of the reheat mode, the air-cooled condenser mode, and the reclaimed heat mode. A human-machine interface 98 is arranged in communication with the controller 94 and allows a user to select a desired combination of modes.

Figure 2:
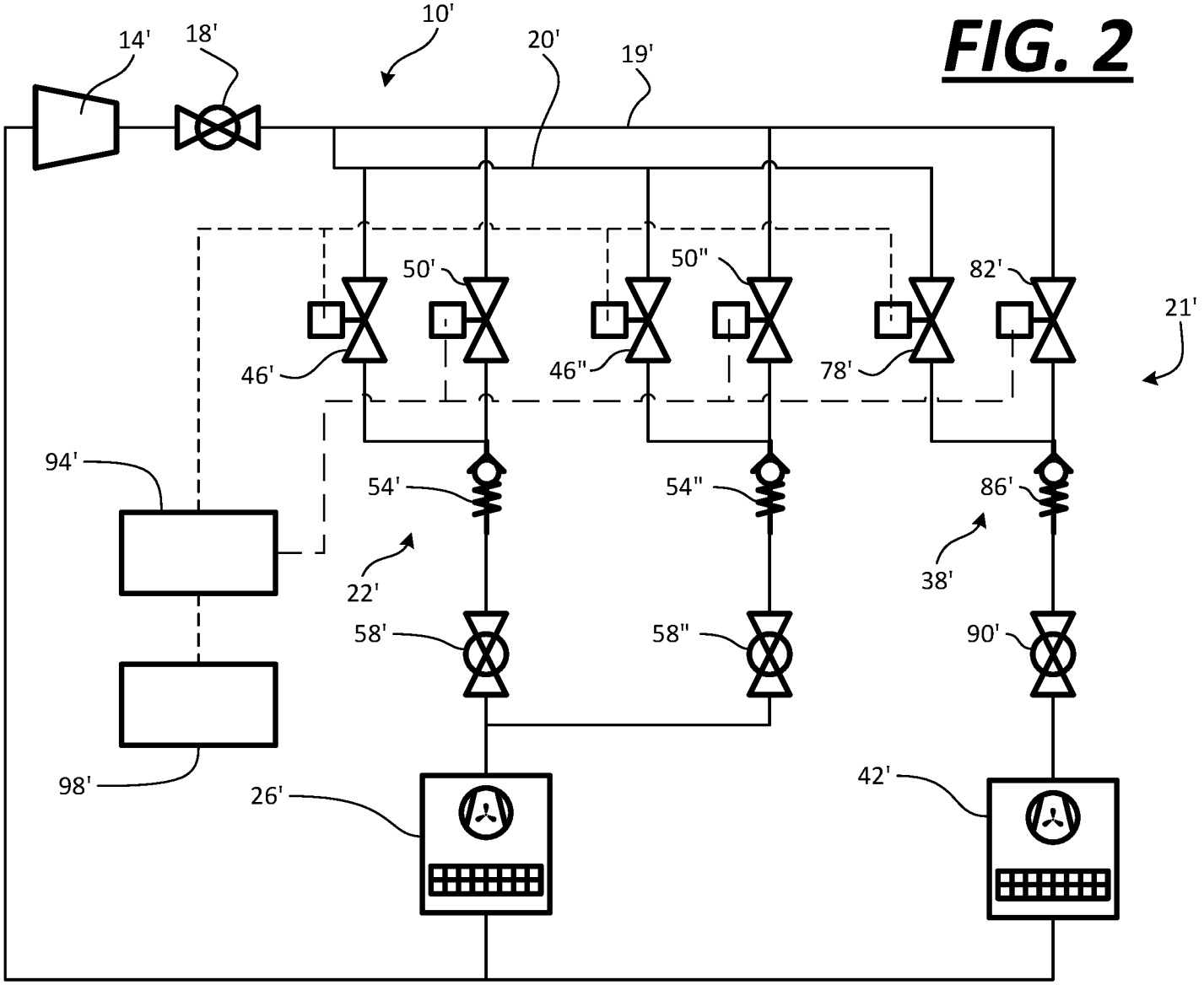
FIG. 2 is a schematic diagram of another pool environment control system including a multi-mode valve manifold, according to some implementations.

As shown in FIG. 2, a pool environment control system 10' similar to the pool environment control system 10 described with respect to FIG. 1 includes a multi-stage reheat branch 22' and an ACC branch 38'. The pool environment control system 10' does not include a heat reclaim branch. Similar parts in the pool environment control system 10' are numbered with reference numbers in the prime series. The multi-stage reheat branch 22' includes a first reheat soft-start electronic solenoid valve 46', a first reheat primary electronic solenoid valve 50', a first reheat check valve 54' and a first reheat isolation valve 58' that selectively provide flow the a reheat system 26'. The multi-stage reheat branch 22' also includes a second reheat soft-start electronic solenoid valve 46", a second reheat primary electronic solenoid valve 50", a second reheat check valve 54", and a second reheat isolation valve 58" that selectively provide flow to the reheat system 26'. The multi-stage reheat branch 22' can provide a broader working range when compared to the single stage reheat branch 22 shown in FIG. 1. In some implementations, a multi-stage ACC branch or a multi-stage heat reclaim branch can be included. In some implementations, multi-stage branches can include more than two stages (e.g., three stages, four stages, etc.).

Controller Architecture

Figure 3:
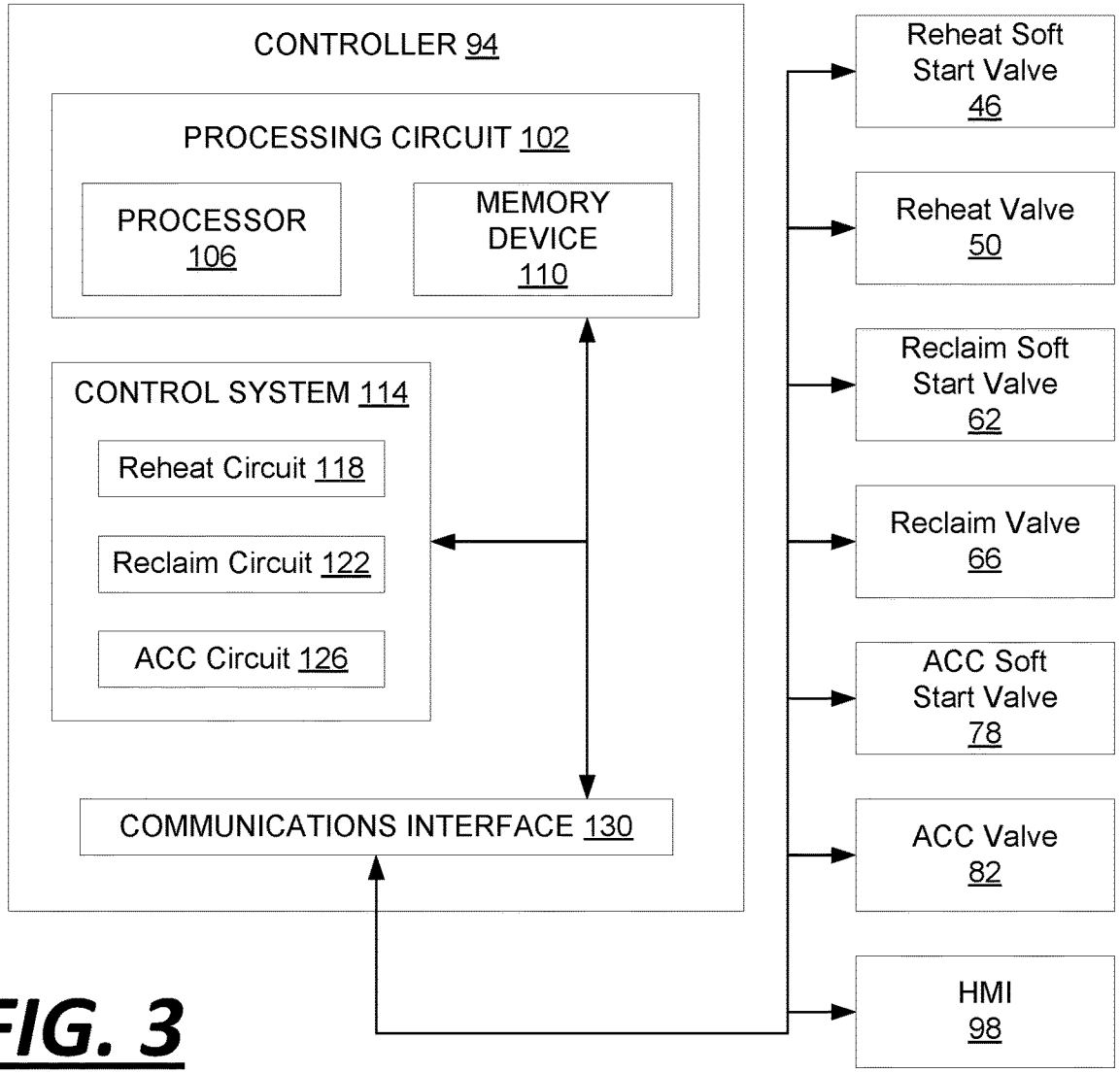
FIG. 3 is a schematic diagram of a control system for the multi-mode valve manifold of FIG. 1, according to some implementation.

Referring now to FIG. 3, a schematic diagram of the controller 94 is shown according to an example implementation. As shown in FIG. 3, the controller 94 includes a processing circuit 102 having a processor 106 and a memory device 110, a control system 114 having a reheat circuit 118, a reclaim circuit 122, and an ACC circuit 126, and a communications interface 130. Generally, the controller 94 is structured to operate the pool environment control system 10 and provide the reheat mode, the air-cooled condenser mode, and the reclaimed heat mode.

In one configuration, the circuits of the control system 114 are in the form of machine or computer-readable media that is executable by a processor, such as processor 106. As described herein, the machine-readable media facilitates performance of certain operations to enable reception and transmission of data. For example, the machine-readable media may provide an instruction (e.g., command, etc.) to acquire data. In this regard, the machine-readable media may include programmable logic that defines the frequency of acquisition of the data (or, transmission of the data). The computer readable media may include code written in any programming language. The computer readable program code may be executed on one processor, multiple co located processors, multiple remote processors, or any combination of local and remote processors. Remote processors may be connected to each other through any type of network (e.g., CAN bus, etc.).

In another configuration, the circuits of the control system 114 are implemented as hardware units, such as electronic control units. As such, the circuits of the control system 114 may be implemented as one or more circuitry components including, but not limited to, processing circuitry, network interfaces, peripheral devices, input devices, output devices, sensors, etc. In some implementations, the circuits of the control system 114 may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." In this regard, the circuits of the control system 114 may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on). The circuits of the control system 114 may also include programmable hardware devices such as field programmable gate arrays, programmable array logic, programmable logic devices or the like. The circuits of the control system 114 may include one or more memory devices for storing instructions that are executable by the processor(s) of the circuits of the control system 114. The one or more memory devices and processor(s) may have the same definition as provided below with respect to the memory device 110 and processor 106. In some hardware unit configurations, the circuits of the control system 114 may be geographically dispersed throughout separate locations in the power system. Alternatively and as shown, the circuits of the control system 114 may be implemented in or within a single unit/housing, which is shown as the controller 94.

In the example shown, the controller 94 includes the processing circuit 102 having the processor 106 and the memory device 110. The processing circuit 102 may be structured or configured to execute or implement the instructions, commands, and/or control processes described herein with respect to the circuits of the control system 114. The depicted configuration represents the circuits of the control system 114 as machine or computer-readable media. However, as mentioned above, this illustration is not meant to be limiting as the present disclosure contemplates other implementations where the circuits of the control system 114, or at least one circuit of the circuits of the control system 114, is configured as a hardware unit. All such combinations and variations are intended to fall within the scope of the present disclosure.

The hardware and data processing components used to implement the various processes, operations, illustrative logics, logical blocks, modules and circuits described in connection with the implementations disclosed herein (e.g., the processor 106) may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, or state machine. A processor also may be implemented as a combination of computing devices, such as a combination of a DSP and a microprocessor, a plurality of microprocessors, one or more microprocessors in conjunction with a DSP core, or any other such configuration. In some implementations, the one or more processors may be shared by multiple circuits (e.g., the circuits of the control system 114 may comprise or otherwise share the same processor which, in some example implementations, may execute instructions stored, or otherwise accessed, via different areas of memory). Alternatively or additionally, the one or more processors may be structured to perform or otherwise execute certain operations independent of one or more co-processors. In other example implementations, two or more processors may be coupled via a bus to enable independent, parallel, pipelined, or multithreaded instruction execution. All such variations are intended to fall within the scope of the present disclosure.

The memory device 110 (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory device 110 may be communicably connected to the processor 106 to provide computer code or instructions to the processor 106 for executing at least some of the processes described herein. Moreover, the memory device 110 may be or include tangible, non-transient volatile memory or non-volatile memory. Accordingly, the memory device 110 may include database components, object code components, script components, or any other type of information structure for supporting the various activities and information structures described herein.

The reheat circuit 118 is structured to receive a reheat-on command from the human-machine interface 98 via the communications interface 130 and to set a reheat-on timer to zero and send an open signal to the reheat soft-start electronic solenoid valve 46 via the communications interface 130. The reheat circuit 118 then increments the reheat-on timer to a predetermined reheat soft-start time. During the predetermined reheat soft-start time the reheat primary electronic solenoid valve 50 is closed and flow is provided to the reheat check valve 54 solely via the reheat soft-start electronic solenoid valve 46. After the predetermined reheat soft-start time, the reheat circuit 118 sends an open command to the reheat primary electronic solenoid valve 50 via the communications interface 130 and the reheat primary electronic solenoid valve 50 is opened. The open signal is then no longer sent to the reheat soft-start electronic solenoid valve 46 so that the reheat soft-start electronic solenoid valve 46 closes. The implementation of the soft-start reduces or eliminates hammering in the reheat branch 22.

The reclaim circuit 122 is structured to receive a reclaim-on command from the human-machine interface 98 via the communications interface 130 and to set a reclaim-on timer to zero and send an open signal to the reclaim soft-start electronic solenoid valve 62 via the communications interface 130. The reclaim circuit 122 then increments the reclaim-on timer to a predetermined reclaim soft-start time. During the predetermined reclaim soft-start time the reclaim primary electronic solenoid valve 66 is closed and flow is provided to the reclaim check valve 70 solely via the reclaim soft-start electronic solenoid valve 62. After the predetermined reclaim soft-start time, the reclaim circuit 122 sends an open command to the reclaim primary electronic solenoid valve 66 via the communications interface 130 and the reclaim primary electronic solenoid valve 66 is opened. The open signal is then no longer sent to the reclaim soft-start electronic solenoid valve 62 so that the reclaim soft-start electronic solenoid valve 62 closes. The implementation of the soft-start reduces or eliminates hammering in the heat reclaim branch 30.

The ACC circuit 126 is structured to receive an ACC-on command from the human-machine interface 98 via the communications interface 130 and to set a ACC-on timer to zero and send an open signal to the ACC soft-start electronic solenoid valve 78 via the communications interface 130. The ACC circuit 126 then increments the ACC-on timer to a predetermined ACC soft-start time. During the predetermined ACC soft-start time the ACC primary electronic solenoid valve 82 is closed and flow is provided to the ACC check valve 86 solely via the ACC soft-start electronic solenoid valve 78. After the predetermined ACC soft-start time, the ACC circuit 126 sends an open command to the ACC primary electronic solenoid valve 82 via the communications interface 130 and the ACC primary electronic solenoid valve 82 is opened. The open signal is then no longer sent to the ACC soft-start electronic solenoid valve 78 so that the ACC soft-start electronic solenoid valve 78 closes. The implementation of the soft-start reduces or eliminates hammering in the ACC branch 38.

While various circuits with particular functionality are shown in FIG. 3, it should be understood that the controller 94 may include any number of circuits for completing the functions described herein. For example, the activities and functionalities of the circuits of the control system 114 may be combined in multiple circuits or as a single circuit. Additional circuits with additional functionality may also be included. Further, the controller 94 may further control other activity beyond the scope of the present disclosure. In some implementations, the circuits described herein may include one or more processing circuits comprising one or more memory devices coupled to one or more processors, the one or more memory devices configured to store instructions thereon that, when executed by the one or more processors, cause the one or more processors to perform the operations performed herein and described with reference to circuits.

As mentioned above and in one configuration, the "circuits" may be implemented in machine-readable medium for execution by various types of processors, such as the processor 106 of FIG. 3. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be implemented in any suitable form and organized within any suitable type of data structure. The operational data may be collected as a single data set, or may be distributed over different locations including over different storage devices, and may exist, at least partially, merely as electronic signals on a system or network.

While the term "processor" is briefly defined above, the term "processor" and "processing circuit" are meant to be broadly interpreted. In this regard and as mentioned above, the "processor" may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some implementations, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

Implementations within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

CONCLUSION

For purposes of this description, certain advantages and novel features of the aspects and configurations of this disclosure are described herein. The described methods, systems, and apparatus should not be construed as limiting in any way. Instead, the present disclosure is directed toward all novel and nonobvious features and aspects of the various disclosed aspects, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

Features disclosed in this specification (including any accompanying claims, abstract, and drawings), and/or all of the steps of any method or process so disclosed, may be combined in any combination, except combinations where at least some of such features and/or steps are mutually exclusive. The claimed features extend to any novel one, or any novel combination, of the features disclosed in this specification (including any accompanying claims, abstract, and drawings), or to any novel one, or any novel combination, of the steps of any method or process so disclosed.

As used in the specification and the appended claims, the singular forms "a", "an", and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about", it will be understood that the particular value forms another aspect. It will be further understood that the endpoints of each of the ranges are significant both in relation to the other endpoint, and independently of the other endpoint. The terms "about" and "approximately" are defined as being "close to" as understood by one of ordinary skill in the art. In one non-limiting aspect the terms are defined to be within 10%. In another non-limiting aspect, the terms are defined to be within 5%. In still another non-limiting aspect, the terms are defined to be within 1%.

The terms "coupled", "connected", and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A communicably "coupled" to circuit B may signify that the circuit A communicates directly with circuit B (i.e., no intermediary) or communicates indirectly with circuit B (e.g., through one or more intermediaries).

Certain terminology is used in the following description for convenience only and is not limiting. The words "right", "left", "lower", and "upper" designate direction in the drawings to which reference is made. The words "inner" and "outer" refer to directions toward and away from, respectively, the geometric center of the described feature or device. The words "distal" and "proximal" refer to directions taken in context of the item described and, with regard to the instruments herein described, are typically based on the perspective of the practitioner using such instrument, with "proximal" indicating a position closer to the practitioner and "distal" indicating a position further from the practitioner. The terminology includes the above-listed words, derivatives thereof, and words of similar import.

Throughout the description and claims of this specification, the word "comprise" and variations of the word, such as "comprising" and "comprises", means "including but not limited to", and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

What is claimed is:

1. A pool environment control system comprising:

a reheat branch including a reheat soft-start electronic solenoid valve configured to fluidly couple to a compressor, a reheat primary electric solenoid valve configured to fluidly couple to the compressor, and a reheat check valve fluidly coupled to the reheat soft-start electronic solenoid valve and the reheat primary electric solenoid valve; and an air-cooled condenser (ACC) branch including an ACC soft-start electronic solenoid valve fluidly coupled to the compressor, an ACC primary electric solenoid valve fluidly coupled to the compressor, and an ACC check valve fluidly coupled to the ACC soft-start electronic solenoid valve and the ACC primary electric solenoid valve, the ACC check valve configured to provide fluid communication with an ACC system.

2. The pool environment control system of claim 1, further comprising:

a primary rail configured to be fluidly coupled to the compressor; and a soft-start rail configured to be fluidly coupled to the compressor.

3. The pool environment control system of claim 2, wherein the reheat primary electric solenoid valve and the ACC primary electric solenoid valve are fluidly coupled to the primary rail, and wherein the reheat soft-start electronic solenoid valve and the ACC soft-start electronic solenoid valve are fluidly coupled to the soft-start rail.

4. The pool environment control system of claim 1, wherein the reheat soft-start electronic solenoid valve and the reheat primary electric solenoid valve provide parallel flow paths between the compressor and the reheat check valve, and wherein the ACC soft-start electronic solenoid valve and the ACC primary electric solenoid valve provide parallel flow paths between the compressor and the ACC check valve.

5. The pool environment control system of claim 1, further comprising an upstream isolation valve arranged upstream of the reheat soft-start electronic solenoid valve, the reheat primary electric solenoid valve, the ACC soft-start electronic solenoid valve, and the ACC primary electric solenoid valve.

6. The pool environment control system of claim 1, further comprising:

a reheat isolation valve positioned downstream of the reheat check valve; and an ACC isolation valve positioned downstream of the ACC check valve.

7. The pool environment control system of claim 1, wherein at least one of the reheat branch or the ACC branch is a multi-stage branch.

8. The pool environment control system of claim 1, further comprising a heat reclaim branch including a reclaim soft-start electronic solenoid valve configured to be fluidly coupled to the compressor, a reclaim primary electric solenoid valve configured to be fluidly coupled to the compressor, and a reclaim check valve fluidly coupled to the reclaim soft-start electronic solenoid valve and the reclaim primary electric solenoid valve, the reclaim check valve configured to provide fluid communication with a heat reclaim system.

9. The pool environment control system of claim 1, further comprising one or more processing circuits comprising one or more memory devices coupled to one or more processors, the one or more memory devices configured to store instructions thereon that, when executed by the one or more processors, cause the one or more processors to:

open the reheat soft-start electronic solenoid valve for a predetermined reheat soft-start time;

open the reheat primary electric solenoid valve after the predetermined reheat soft-start time;

close the reheat soft-start electronic solenoid valve after the predetermined reheat soft-start time;

open the ACC soft-start electronic solenoid valve for a predetermined ACC soft-start time;

open the ACC primary electric solenoid valve after the predetermined ACC soft-start time; and close the ACC soft-start electronic solenoid valve after the predetermined ACC soft-start time.

10. A multi-mode valve manifold comprising:

a primary rail configured to fluidly couple to an upstream isolation valve;

a soft-start rail configured to fluidly couple to the upstream isolation valve;

a reheat branch including a reheat soft-start electronic solenoid valve fluidly coupled to the soft-start rail, a reheat primary electric solenoid valve fluidly coupled to the primary rail, and a reheat isolation valve coupled to the reheat soft-start electronic solenoid valve and the reheat primary electric solenoid valve;

a heat reclaim branch including a reclaim soft-start electronic solenoid valve fluidly coupled to the soft-start rail, a reclaim primary electric solenoid valve fluidly coupled to the primary rail, and a reclaim isolation valve coupled to the reclaim soft-start electronic solenoid valve and the reclaim primary electric solenoid valve and configured to selectively provide fluid flow to a heat reclaim system; and an air-cooled condenser (ACC) branch including an ACC soft-start electronic solenoid valve fluidly coupled to the soft-start rail, an ACC primary electric solenoid valve fluidly coupled to the primary rail, and an ACC isolation valve coupled to the ACC soft-start electronic solenoid valve and the ACC primary electric solenoid valve and configured to selectively provide fluid flow to an ACC system.

11. The multi-mode valve manifold of claim 10, wherein at least one of the reheat branch, the heat reclaim branch, or the ACC branch is a multi-stage branch.

12. The multi-mode valve manifold of claim 10, wherein the reheat branch includes a reheat check valve fluidly coupled upstream of the reheat isolation valve, wherein the heat reclaim branch includes a reclaim check valve fluidly coupled upstream of the reclaim isolation valve, and wherein the ACC branch includes an ACC check valve fluidly coupled upstream of the ACC isolation valve.

13. The multi-mode valve manifold of claim 10, wherein the reheat soft-start electronic solenoid valve and the reheat primary electric solenoid valve provide parallel flow paths between the upstream isolation valve and the reheat isolation valve, wherein the reclaim soft-start electronic solenoid valve and the reclaim primary electric solenoid valve provide parallel flow paths between the upstream isolation valve and the reclaim isolation valve, and wherein the ACC soft-start electronic solenoid valve and the ACC primary electric solenoid valve provide parallel flow paths between the upstream isolation valve and the ACC isolation valve.

14. The multi-mode valve manifold of claim 10, further comprising one or more processing circuits comprising one or more memory devices coupled to one or more processors, the one or more memory devices configured to store instructions thereon that, when executed by the one or more processors, cause the one or more processors to:

open the reheat soft-start electronic solenoid valve for a predetermined reheat soft-start time;

open the reheat primary electric solenoid valve after the predetermined reheat soft-start time;

close the reheat soft-start electronic solenoid valve after the predetermined reheat soft-start time;

open the reclaim soft-start electronic solenoid valve for a predetermine reclaim soft-start time;

open the reclaim primary electric solenoid valve after the predetermined reclaim soft-start time;

close the reclaim soft-start electronic solenoid valve after the predetermined reclaim soft-start time;

open the ACC soft-start electronic solenoid valve for a predetermined ACC soft-start time;

open the ACC primary electric solenoid valve after the predetermined ACC soft-start time; and close the ACC soft-start electronic solenoid valve after the predetermined ACC soft-start time.

15. A non-transitory computer readable media having computer-executable instructions embodied therein that, when executed by a circuit of a pool environment control system, causes the pool environment control system to perform functions comprising:

opening a reheat soft-start electronic solenoid valve for a predetermined reheat soft-start time;

opening a reheat primary electric solenoid valve after the predetermined reheat soft-start time;

closing the reheat soft-start electronic solenoid valve after the predetermined reheat soft-start time;

opening an air-cooled condenser (ACC) soft-start electronic solenoid valve for a predetermined ACC soft-start time;

opening an ACC primary electric solenoid valve after the predetermined ACC soft-start time; and closing the ACC soft-start electronic solenoid valve after the predetermined ACC soft-start time.

16. The non-transitory computer readable media having computer-executable instructions of claim 15, wherein the functions comprise:

opening a reclaim soft-start electronic solenoid valve for a predetermined reclaim soft-start time;

opening a reclaim primary electric solenoid valve after the predetermined reclaim soft-start time; and closing the reclaim soft-start electronic solenoid valve after the predetermined reclaim soft-start time.

17. The non-transitory computer readable media having computer-executable instructions of claim 16, wherein the functions comprise:

receiving a reclaim-on command from a human-machine interface; and starting the predetermined reclaim soft-start time in response to receiving the reclaim-on command.

18. The non-transitory computer readable media having computer-executable instructions of claim 15, wherein the functions comprise:

receiving a reheat-on command from a human-machine interface; and starting the predetermined reheat soft-start time in response to receiving the reheat-on command.

19. The non-transitory computer readable media having computer-executable instructions of claim 15, wherein the functions comprise:

receiving an ACC-on command from a human-machine interface; and starting the predetermined ACC soft-start time in response to receiving the ACC-on command.

20. The non-transitory computer readable media having computer-executable instructions of claim 15, wherein the functions comprise:

controlling a two-stage reheat branch including the reheat soft-start electronic solenoid valve, a second reheat soft-start electronic solenoid valve, the reheat primary electric solenoid valve, and a second reheat primary electric solenoid valve.

* * * * *